United States Patent [19]

Wilkerson

[11] 4,094,381

[45] June 13, 1978

[54] AERIAL EXTENSION LADDER

[76] Inventor: Darrell F. Wilkerson, 1700 W. Reno, Oklahoma City, Okla. 73106

[21] Appl. No.: 793,201

[22] Filed: May 2, 1977

[51] Int. Cl.[2] ..... E06C 5/06

[52] U.S. Cl. ..... 182/67; 182/2; 182/208; 52/121

[58] Field of Search ..... 182/2, 64, 65, 66, 67, 182/68, 208; 212/55, 17, 144; 52/118, 121

[56] References Cited

U.S. PATENT DOCUMENTS

| | | | |
|---|---|---|---|
| 2,614,743 | 10/1952 | Arps | 182/66 |
| 3,467,217 | 9/1969 | Zwight | 182/2 |
| 3,572,467 | 3/1971 | Hall | 182/67 |
| 3,845,596 | 11/1974 | Veenstra | 52/118 |

*Primary Examiner*—Reinaldo P. Machado
*Attorney, Agent, or Firm*—Robert K. Rhea

[57] ABSTRACT

A truck mounted telescopically extensible ladder is rotatably connected to a turret and pivoted about an elevation cylinder. A double acting-double end hydraulic cylinder, mounted in the base ladder section, is connected by a cable and pulleys to an intermediate ladder section for extending and retracting the latter. A top ladder section is connected to the intermediate ladder section by a cable entrained around pulleys at the respective ends of the intermediate ladder section and secured to the upper end portion of the base ladder section for telescopically extending the top ladder section in response to telescopic extension off the intermediate ladder section.

4 Claims, 8 Drawing Figures

AERIAL EXTENSION LADDER

BACKGROUND OF THE INVENTION

1. Field of the Invention.

The present invention relates to extension ladders and more particularly to a vehicle supported extension ladder adapted for lying in a retracted horizontal position during travel of the vehicle and to be raised at an angle for use.

2. Description of the Prior Art.

Portable telescoping derricks or aerial ladders are well known and have usually included elongated hydraulic cylinders and piston rods to achieve the extending and retracting action of the several sections, such as shown by U.S. Pat. No. 2,923,381. Other load lifting devices, generally known as booms, feature a plurality of sections telescoping into each other and each being actuated by a separate hydraulic cylinder, such as shown by U.S. Pat. No. 3,721,054.

The principal objection to the use of elongated cylinders and piston rods is maintaining sufficient rigidity of the telescopically extended sections to prevent lateral movement of the extended piston rod and damage thereto and leaking of hydraulic fluid. Another objection to aerial ladders, as shown by the prior art, which employes a plurality of hydraulic cylinders for extending or retracting the ladder or boom has been the time delay in extending and retracting the plurality of sections wherein one cylinder must be extended or retracted before the next hydraulic cylinder is actuated for the respective direction of movement.

This invention provides a sturdily constructed plurality of relatively lightweight telescopically extensible and retractable ladder sections which are actuated for the telescoping movement by a single double acting-double end hydraulic extension cylinder mounted in the base ladder section and connected by cables and pulleys with the remaining ladder sections in a manner to obtain longitudinal extension and retraction of the movable ladder sections on a ratio movement for each ladder section of six units of distance for each unit of extension or retraction of the hydraulic cylinder piston rod.

SUMMARY OF THE INVENTION

A telescoping ladder comprises a turret type base mounted on the bed of a vehicle and connected with a base ladder section for pivoting movement of the ladder sections about vertical and horizontal axes. A base connected elevation cylinder raises and lowers the ladder sections about a horizontal axis. An elongated double acting-double end hydraulic cylinder longitudinally mounted in the base ladder section is connected by a cable entrained over a plurality of pulleys secured respectively to the respective end portions of the base ladder section and both ends of the hydraulic cylinder piston rod and secured to an intermediate ladder section for longitudinally extending and retracting the intermediate ladder section. A top ladder section is secured to a cable entrained around the respective ends of the intermediate ladder section for extending and retracting the top ladder section in response to extension and retraction of the intermediate section. A workman's platform is pivotally connected with the top end portion of the top ladder section and positioned in workman's supported relation by gravity when the top ladder section is extended. The workman's platform is retracted into the upper end portion of the top ladder section when the top ladder section is telescopically retracted. A safety catch prevents separation of the rotatable portion of the turret and a collapse of the ladder in the event of turret bearing failure and separating movement of the rotatable portion of the turret with respect to its base.

The principal object of this invention is to provide an extensible telescopic aerial ladder rotatably connected to a turret mounted on a vehicle which includes hydraulic cylinder operated cable and pulley members for easily and quickly telescopically extending and retracting the ladder sections.

DESCRIPTION OF THE PREFERRED EMBODIMENT

Figure 3:
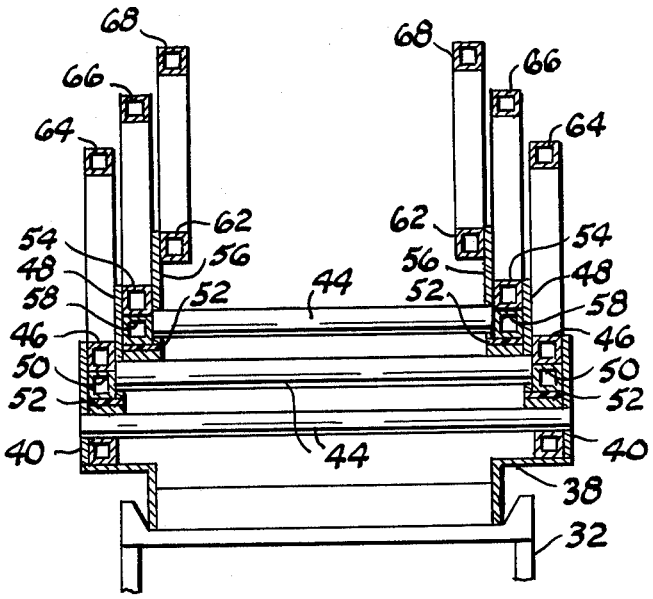
FIG. 3 is a vertical cross sectional view taken substantially along the line 3—3 of FIG. 1.

Like characters of reference designate like parts in those figures of the drawings in which they occur.

Figure 1:
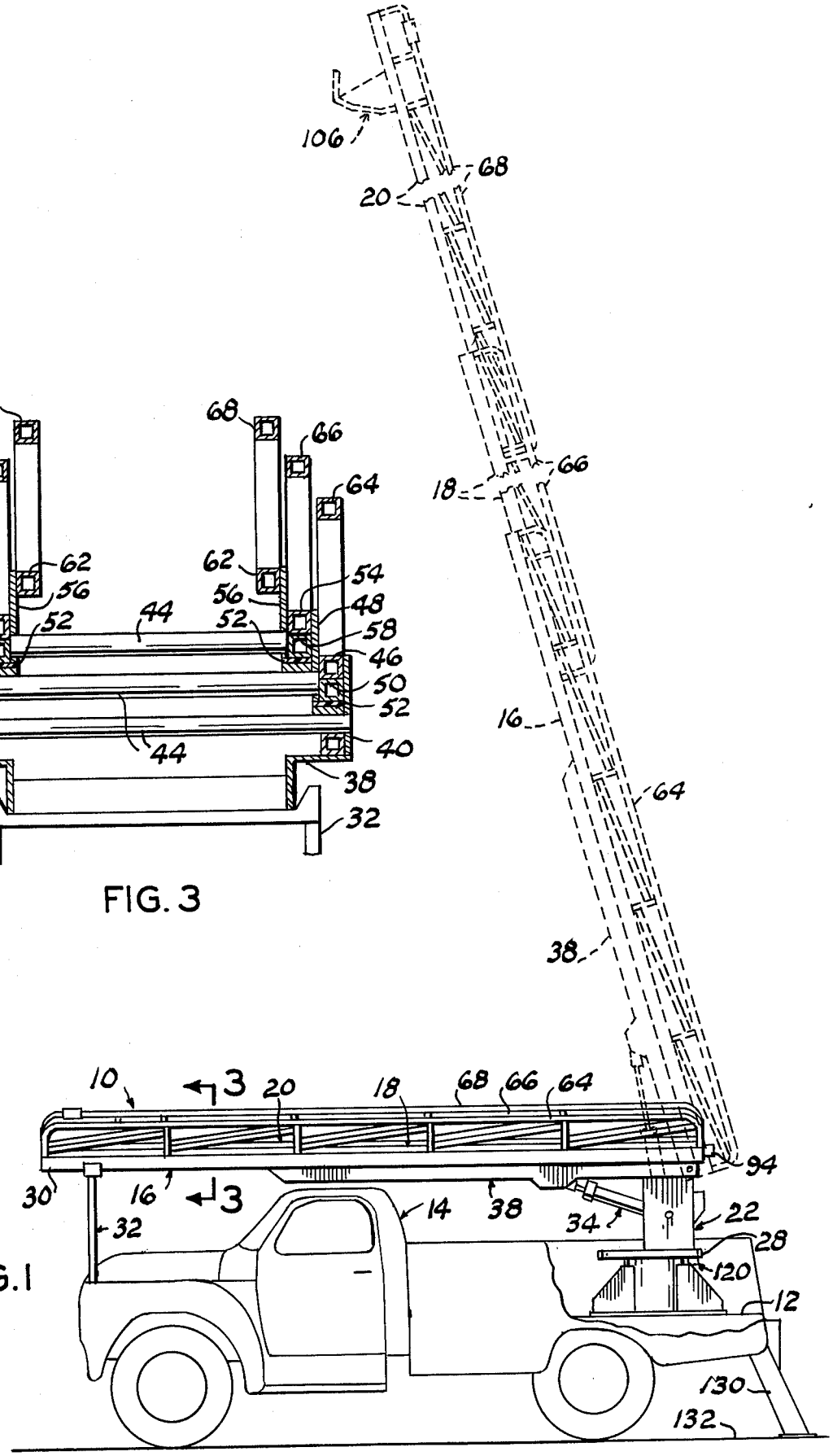
FIG. 1 is a side elevational view of the vehicle mounted telescopically retracted ladder and illustrating, by dotted lines, a telescopically extended position of the ladder sections.

In the drawings:

The reference numeral 10 indicates the ladder, as a whole, mounted on the floor or bed 12 of a pickup truck 14, or the like, for providing access to an overhead lamp, not shown, or the like. The ladder is formed by three telescopically extensible sections 16, 18 and 20. The ladder section 16, 18 and 20 are hereinafter referred to as base ladder section, intermediate ladder section and top ladder section, respectively. One end of the base ladder section 16 is secured to a turret 22 mounted on a base 24 secured to the truck bed 12. The turret 22, being journalled for rotation about the vertical axis of a conventional gear and bearing member 28, permits the ladder sections to be swung in lateral directions. When in its folded or collapsed position, the ladder base section 16 is supported at its forward end portion 30 by a ladder support 32, which may be a platform, projecting upwardly from or overlying the forward end portion of the vehicle 14. In this position the base ladder section 16 supports the intermediate ladder section 18 which in turn supports the top ladder section 20. The ladder sections are lifted from the horizontal to an upwardly inclined position, such as illustrated by dotted lines (FIG. 1), by a hydraulic lift cylinder 34 pivotally connected, at one end, with the turret 22 and having its pistion rod connected with a transverse brace 36 intermediate the ends of a support frame 38 underlying and secured to the base ladder section and having one end pivotally connected to the turret 22.

Referring also to FIG. 3, the base ladder section 16 comprises a pair of plates 40 arranged in parallel spaced-apart relation overlying and secured to one edge of the respective spaced-apart angle members forming the base ladder section frame support 38. The ladder plates 40 are transversely interconnected by a plurality of longitudinally spaced-apart rungs 44. Elongated tubular tracks 46, preferably square in cross section, are coextensive with and secured to the respective inner surface of the ladder plates 40 adjacent their upwardly disposed longitudinal edges opposite the frame support 38.

The intermediate ladder section 18 similarly comprises a pair of elongated spaced-apart plates 48 similarly tranversely connected by a plurality of the ladder rungs 44. The spacing between the plates 48 is such they are longitudinally received slidably by the respective inward surface of the base ladder section tracks 46. A pair of elongated tubular tracks 50, preferably square in cross section, are secured to the outer surface of the respective plate 48 in underlying slidable contacting relation with respect to the base ladder section tracks 46 thus preventing upward movement of the intermediate ladder section with respect to the base ladder section but permitting longitudinal telescopic movement of the base and intermediate ladder sections with respect to each other. The intermediate ladder section tracks 50 overly and are slidably supported by pairs of rail glides 52, preferably formed from material having a low coefficient of friction, secured in longitudinally spaced relation to the inward surface of the base ladder section plates 40 including a pair of rollers 53 (FIG. 7) disposed at the top end portion of the plates 40. Similarly, the confronting upper longitudinal edge portions of the intermediate ladder section plates 48 are provided with a pair of coextensive tracks 54.

The top ladder section 20 is formed substantially identical with respect to the intermediate ladder section 18 and comprises a pair of elongated plates 56 arranged in parallel spaced-apart relation and similarly transversely interconnected by another plurality of the ladder rungs 44. The top ladder section includes a pair of tracks 58 secured to the outer surface of its plates 56 in underlying relation with respect to the intermediate ladder section top rails 54 and are similarly supported by low friction track glides 52 and rollers 53 (FIG. 7) thus permitting longitudinal telescoping movement of the top ladder section 20 within the intermediate ladder section 18. The top ladder section 20 is similarly provided with a pair of tubular tracks 62 secured to the inner surface of the top ladder section plates 56 adjacent their upper limit to impart rigidity to the top ladder section. Each of the ladder sections 16, 18 and 20 are provided with a pair of hand rails 64, 66 and 68, respectively, and are respectively secured, by pairs, to the uppermost, as viewed in FIG. 3, ladder section top rails 50, 54 and 62, the respective hand rails being interconnected by transverse and angularly disposed brace members 70 and 72, respectively.

Figure 7:
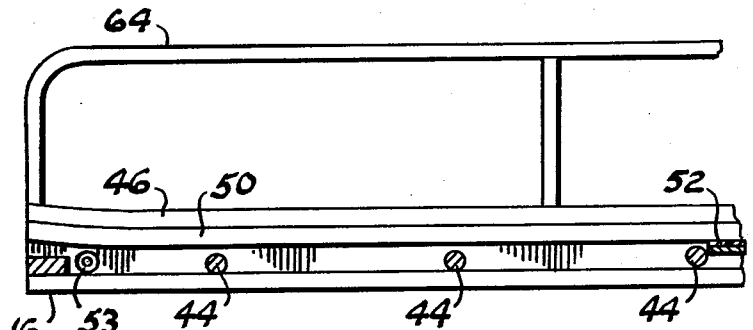
FIG. 7 is a fragmentary elevational view, to another scale, illustrating the ladder sections supported by bearing members; and, FIG. 8 is a fragmentary elevational view, partially in section, illustrating the manner of preventing separating action of the base support bearing in the event of bolt failure.

As shown by FIG. 7, the top end portions of the tracks 50 and 58 are curved upwardly so that when the ladder sections are in travel position these track end portions are not supported by the rollers 53 to prevent constant vibration wearing a recess in the respective track.

Figure 2:
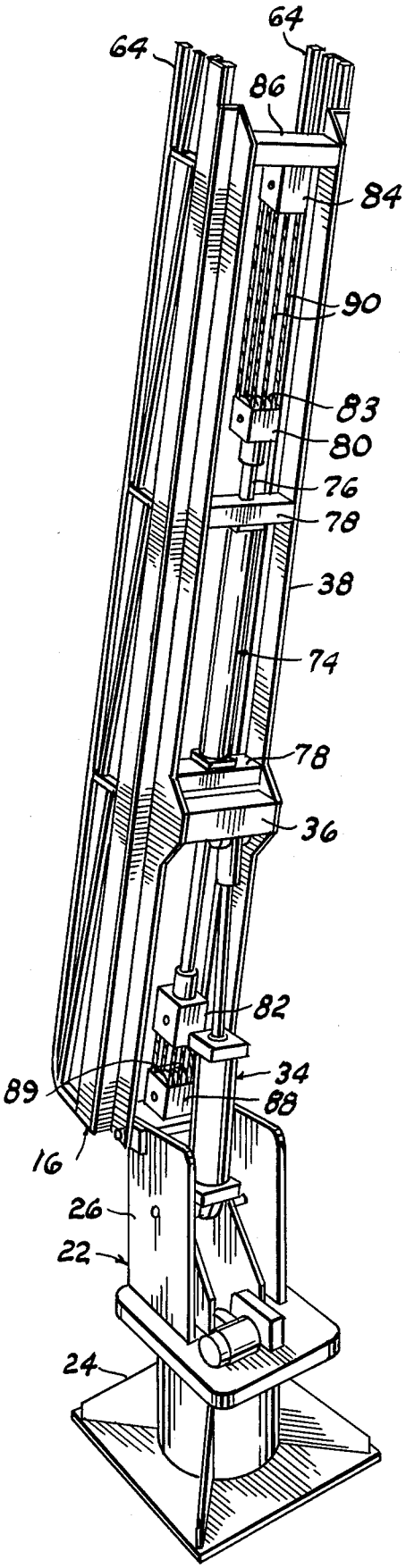
FIG. 2 is a fragmentary perspective view, to a larger scale, of the depending end portion of the ladder when lifted and telescopically extended.

A double acting hydraulic cylinder 74 (FIG. 2), having its piston rod 76 projecting beyond its opposing ends, extends longitudinally within an intermediate portion of the base ladder section support frame 38 and is connected between a pair of transverse brackets 78 secured to the frame support 38 with the respective ends of the piston rod 76 projecting through these brackets and connected with upper and lower pulley brackets 80 and 82, each journaling a plurality of pulleys 83. The hydraulic cylinder 74 extends and retracts the intermediate and top ladder sections 18 and 20 in the manner explained hereinbelow.

An upper pulley bracket 84, similarly journalling a plurality of pulleys, not shown, is secured to a transverse brace 86 at the end portion of the support frame opposite the turret. Similarly, a pulley support bracket 88, containing a plurality of pulleys 89, is secured to a similar transverse brace extending between the support frame adjacent its connection with the turret 22.

Figure 6:
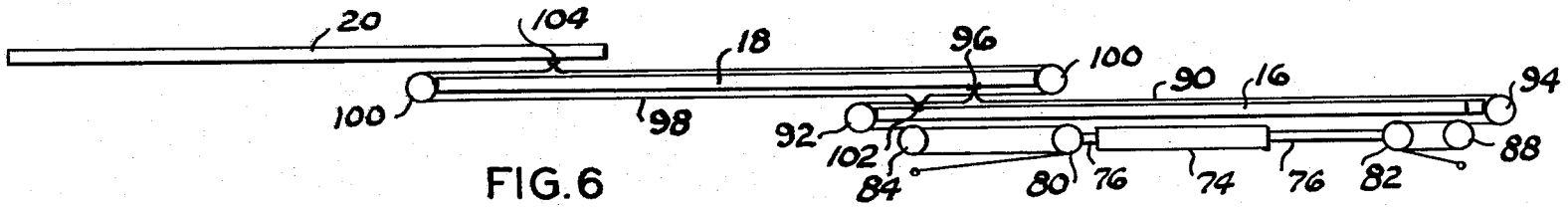
FIGS. 5 and 6 are schematics respectively illustrating the ladder sections in stored and telescopically extended positions.
Figure 5:
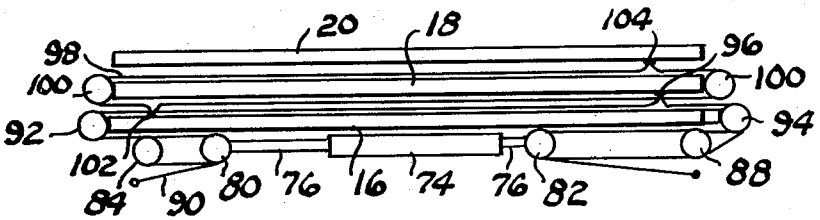

Referring also to FIGS. 5 and 6, a cable 90 has its respective ends anchored to respective end portions of the support frame 38 and is entrained intermediate its ends, a plurality of runs, over and between the pulleys contained by the pulley brackets 80 and 84 over a pulley 92 at the end of the base ladder section opposite the turret and extends longitudinally of the base ladder section and is entrained over a pulley 94 at the turret end of the base ladder section and is similarly entrained a plurality of runs over and between the pulleys contained by the pulley brackets 82 and 88. As stated hereinabove, the block and tackle arrangement of the cable 90 and pulley brackets is preferably such that the ratio of movement of the intermediate and top ladder sections with respect to the cylinder rod 76 is 6:1. Intermediate its ends, the cable 90 is connected to a cross brace, not shown, secured to the intermediate ladder section 18, as at 96. Another cable 98 extends longitudinally of the intermediate ladder section 18 around pulleys 100 at the respective ends thereof and is connected at its respective ends to a cross brace, not shown, of the base ladder section, as at 102. Intermediate its ends the cable 98 is similarly connected with a cross brace, not shown, at the depending end portion of the top ladder section, as at 104. When the hydraulic cylinder 74 is actuated to move its piston rod toward the turret, decreasing the spacing between the pulley brackets 82 and 88 and increasing the spacing between the pulley brackets 80 and 84, the attached position 96 of the cable 90 with the intermediate ladder section telescopically moves toward the left, as viewed in FIG. 5, thus simultaneously moving the intermediate ladder section toward a telescopically extended position relative to the base ladder section while simultaneously the movement of the intermediate ladder section within the cable 98 moves its top ladder section connected position 104 to the left, as viewed in FIG. 5, thus simultaneously telescopically extending the top ladder section 20. This extended position of the ladder is shown by FIG. 6 wherein the end portions of the intermediate ladder section remains in selected overlapping relation with respect to adjacent end portions of the top and base ladder sections, respectively. This ladder telescoping extension action is reversed by moving the hydraulic cylinder rod 76 to the left, as viewed in FIGS. 5 and 6, for telescopically retracting the top and intermediate ladder sections to a stored travel position, as shown by FIG. 5.

Figure 4:
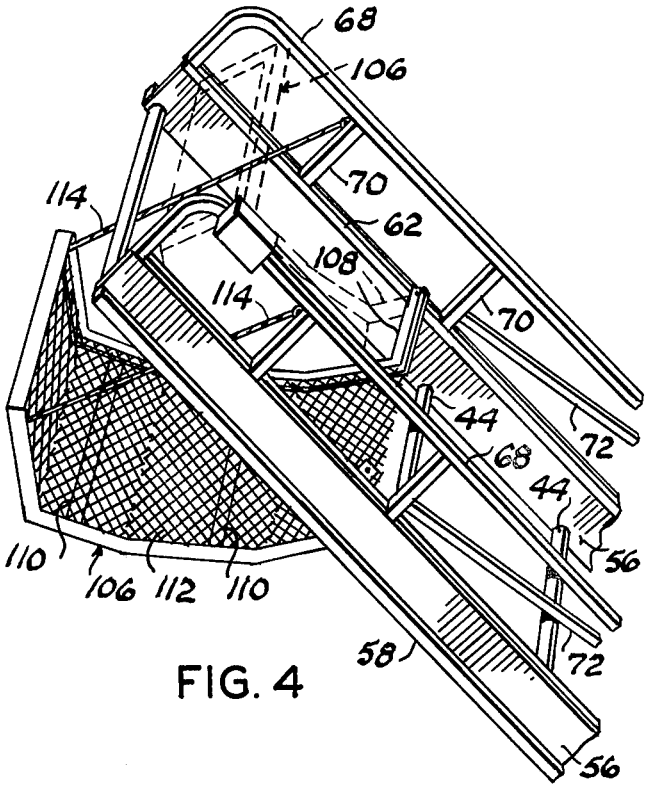
FIG. 4 is a fragmentary perspective view, to a different scale, of the upper end portion of the top ladder section illustrating, by solid lines, the workman's platform in operative position and illustrating its stored position by dotted lines.

Referring now to FIG. 4, the uppermost end portion of the top ladder section 20 is provided with a workman's support or platform 106 comprising a generally U-shaped bracket having the ends of its legs 108 pivotally connected with the track members 62 and provided with intermediate cross braces 110. A section of expanded metal 112, extending between and secured to the legs of the platform 106, completes the support which is dimensioned so that it may pivot, by gravity, out of the confines of the top end portion of the top ladder section when the top ladder section is elevated and the top end portion of the top ladder section projects beyond the intermediate ladder section. A pair of flexible members 114, secured to the legs of the platform and the hand rails 68 of the top ladder section, maintain the platform 106 in workman's supporting position when lowered, by gravity, to its solid line position of FIG. 4. When the top ladder section 20 is telescoped into the intermediate ladder section 18, the platform 106 is folded, by contact with the intermediate ladder section, into the top ladder section end portion, as shown by dotted lines (FIG. 4). The workman's support platform 106 is substantially equivalent to the workman's platform disclosed by U.S. Pat. No. 2,238,665 and is set forth herein to disclose a manner of supporting a workman at the uppermost end portion of the top ladder section 20.

Figure 8:
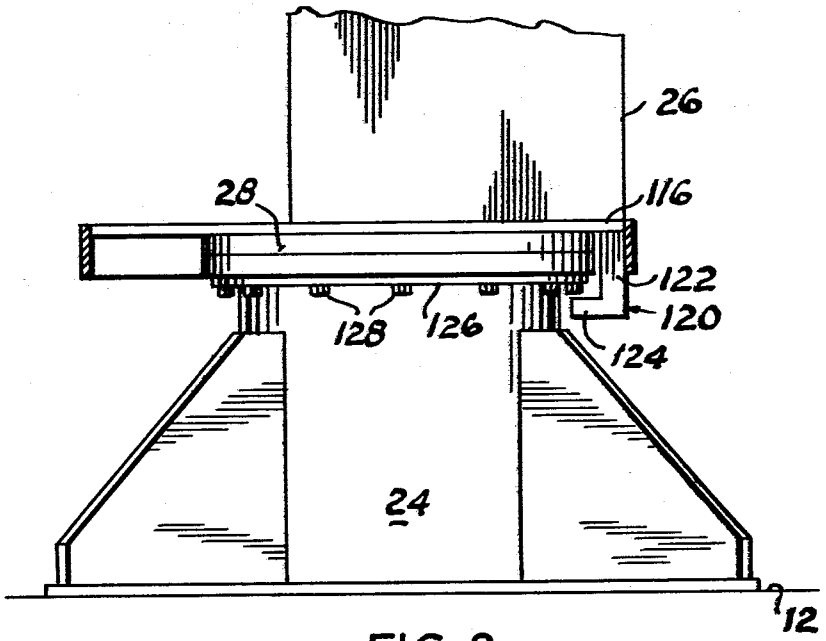

Referring now to FIG. 8, the rearward end portion of the turret base 116, overlying the turret bearing 28 and underlying the connection of the frame support 38 with the turret, is provided with one or more depending L-shaped brackets 120 having its leg portion 122 secured to the turret base 116 and its foot portion 124 underlying, in close spaced relation, the depending limit of the bearing supporting top plate 126 of the base 24 for the purpose of preventing separation of the turret from the base in the event of failure of one or more bearing mounting bolts 128. Thus, the purpose of the brackets 122 is to provide a safety feature preventing collapse of the telescopically extended ladder sections in the event of bearing bolt failure.

OPERATION

The ladder is normally in its collapsed or folded position and the truck is moved to a point disposed near and below an overhead position to be reached by telescopically extending the ladder sections. The vehicle 14 is leveled as near as possible. The rearward end portion of the vehicle 14 is preferably provided with stabilizers 130 which are lowered to contact the surface of the earth 132 and assist in supporting the mass of the ladder 10. The ladder sections are then elevated by actuating the elevation cylinder 34 and telescopically extending the ladder sections by actuating the extension cylinder 74 in the manner described hereinabove. This action can be reversed, that is, the ladder sections extended and then elevated to their dotted line position of FIG. 1, if desired. The turret may be operated to swing the ladder in either direction by rotating the turret about the vertical axis of the base 24. A workman may either climb the ladder along the rungs thereof or, with the ladder sections extended so that the operator's platform 106 is lowered to its workman's supported position for receiving the workman and then lifted with the ladder by the elevation cylinder 34.

Obviously the invention is susceptible to changes or alterations without defeating its practicability. Therefore, I do not wish to be confined to the preferred embodiment shown in the drawings and described herein.

I claim:

1. An aerial ladder including a base ladder section and a top ladder section in combination with a vehicle having a flat bed and a turret mounted on the flat bed for pivoting movement about a vertical axis, the improvement comprising:

a support frame underlying and secured to said base ladder section, said support frame having a lower end pivotally connected with said turret for pivoting movement of its other end in a vertical plane;

a hydraulic lift cylinder extending between the turret and the support frame for tilting the latter about a horizontal axis;

a double acting hydraulic extension cylinder longitudinally secured within said support frame intermediate the ends of the latter, said extension cylinder having a double end piston rod reciprocating from its respective ends;

a pair of pulleys connected with the respective end portions of said base ladder section;

a pulley bracket, journalling a plurality of pulleys, secured to each end of said piston rod and to the respective end portion of said support frame forming cooperating pairs of pulley brackets; and, a base ladder section cable secured at its respective ends to respective ends of said support frame and entrained around said pair of pulleys and between the plurality of pulleys of the respective pair of pulley brackets for movement of an intermediate portion of said base ladder cable longitudinally of said base ladder section, said base ladder cable being connected intermediate its ends with said top ladder section.

2. The combination according to claim 1 and further including:

an intermediate ladder section telescopically interposed between said base ladder section and said top ladder section;

a second pair of pulleys journalled by the respective end portions of said intermediate ladder section; and, an intermediate cable extending longitudinally in endless fashion around said second pair of pulleys and said intermediate ladder section and being secured at longitudinally spaced positions to said base ladder section and said top ladder section, respectively.

3. The combination according to claim 2 in which said turret is characterized by a turret base overlying a turret bearing in turn overlying a base top plate, and further including:

a safety bracket depending from said turret base laterally of said turret bearing and having a lateral extension underlying an edge portion of said base top plate.

4. The combination according to claim 3 in which said ladder sections are each characterized by longitudinally extending parallel side plates, and further including:

pairs of tracks cooperatively secured longitudinally to said plates for telescoping movement of said ladder sections; and, low friction glides supporting said tracks.

* * * * *